United States Patent [19]

Ball et al.

[11] 3,936,344

[45] Feb. 3, 1976

[54] APPARATUS FOR USE IN THE MANUFACTURE OF A WIRING HARNESS

[75] Inventors: Lewis John Ball; Gordon Roy Frank Smith; William Lawrence Fry, all of Newcastle, England

[73] Assignee: Rist's Wires and Cables Limited, England

[22] Filed: Aug. 13, 1973

[21] Appl. No.: 387,636

[30] Foreign Application Priority Data

Aug. 12, 1972 United Kingdom ..... 37708/72
Nov. 17, 1972 United Kingdom ..... 53086/72

[52] U.S. Cl. ..... 156/385; 156/47; 156/178; 156/306; 156/436; 156/499; 156/538; 156/577

[51] Int. Cl. ..... H01b 13/00

[58] Field of Search ..... 156/178, 306, 322, 385, 156/436, 499, 538, 577, 47

[56] References Cited

UNITED STATES PATENTS

| | | | |
|---|---|---|---|
| 3,226,278 | 12/1965 | Scofield et al. | 156/497 |
| 3,481,802 | 12/1969 | Marcell | 156/436 |
| 3,523,844 | 8/1970 | Crimmins et al. | 156/436 |
| 3,582,430 | 6/1971 | Benigno | 156/322 |
| 3,733,428 | 5/1973 | Fry | 156/178 |
| 3,788,917 | 1/1974 | Linda | 156/322 |

FOREIGN PATENTS OR APPLICATIONS

| | | | |
|---|---|---|---|
| 638,376 | 6/1950 | United Kingdom | |
| 818,066 | 8/1959 | United Kingdom | |
| 1,089,952 | 11/1967 | United Kingdom | |
| 1,192,259 | 5/1970 | United Kingdom | |
| 1,790,215 | 1/1972 | Germany | |
| 682,257 | 3/1964 | Canada | 156/499 |

*Primary Examiner*—Daniel J. Fritsch
*Attorney, Agent, or Firm*—Holman & Stern

[57] ABSTRACT

Apparatus for use in the manufacture of a wiring harness includes a platform upon which the harness leads are supported. Each of the leads comprises an outer thermoplastic sheath containing a conductive core, and the apparatus is provided with a thermoplastic tape dispenser whereby thermoplastic tape can be dispensed onto the harness leads. A heater is provided for heating the mutually presented surfaces of the leads and the tape, and a pressure member urges the heated surfaces of the tape and the leads into contact so that the sheaths of the leads fuse to the tape. The heater, the dispenser and the pressure member define a unit which is movable along the length of the leads fusing tape to the leads as it progresses. The heater means can take a number of different forms including hot air blowing apparatus and radiant heating apparatus.

14 Claims, 8 Drawing Figures

APPARATUS FOR USE IN THE MANUFACTURE OF A WIRING HARNESS

This invention relates to apparatus for use in the manufacture of a wiring harness.

Apparatus according to the invention includes a platform upon which the harness leads, each including an outer, thermoplastic sheath, are supported, a dispenser for dispensing thermoplastic tape onto the harness leads, means for heating the mutually presented surfaces of the leads and the tape, a pressure member urging the heated surfaces of the tape and the leads into contact so that the sheaths of the leads fuse to the tape, and further means whereby the leads and the tape can be moved relative to the heater means and the pressure member in the direction of the length of the tape so that the sheaths of the leads are fused to the tape along its length.

Preferably the heater means is a hot air blower.

Alternatively the heater means includes a radiant heat source and means for focussing radiant heat from the source onto the mutually presented surfaces of the leads and the tape.

As a further alternative the heater means can be a laser.

Desirably the radiant heat source is an infra-red source and the associated focussing means is an ellipsoidal reflector.

Alternatively the radiant heat source is an incandescent filament and the focussing means associated with the filament is a lens system.

Preferably, said pressure member is a roller with a resilient surface whereby the roller can accommdate leads of different diameter in the same operation.

Conveniently where the harness to be produced includes leads of different diemater then said platform includes an upstanding rib whereby leads of large diameter can be spaced from leads of smaller diameter laterally of the platform.

Conveniently the tape dispenser, the pressure member, and the heater means are combined to form a single unit supported on the platform.

Desirably the leads are stationary on the platform, during operation of the apparatus, and said unit moves along the platform so that tape is dispensed onto, and fused to, the leads as the unit moves along the platform.

Conveniently said unit includes a drive arrangement whereby the unit is driven along the platform, the platform including guideways guiding the movement of the unit along the platform.

Preferably the platform includes a pair of parallel lead supporting portions extending along the length of the platform and spaced apart, the platform including at one end thereof a turntable whereby said unit can perform an operating stroke along one of said lead supporting portions, and then can be rotated through 180° using said turntable in order to perform an operating stroke in the other direction along said other lead supporting portion.

Desirably the platform includes a turntable at both ends thereof.

Conveniently the or each lead supporting portion of the platform is provided with transversely extending apertures whereby leads can be inserted and led out of the harness intermediate the ends of the taped portion of the harness.

Figure 1:
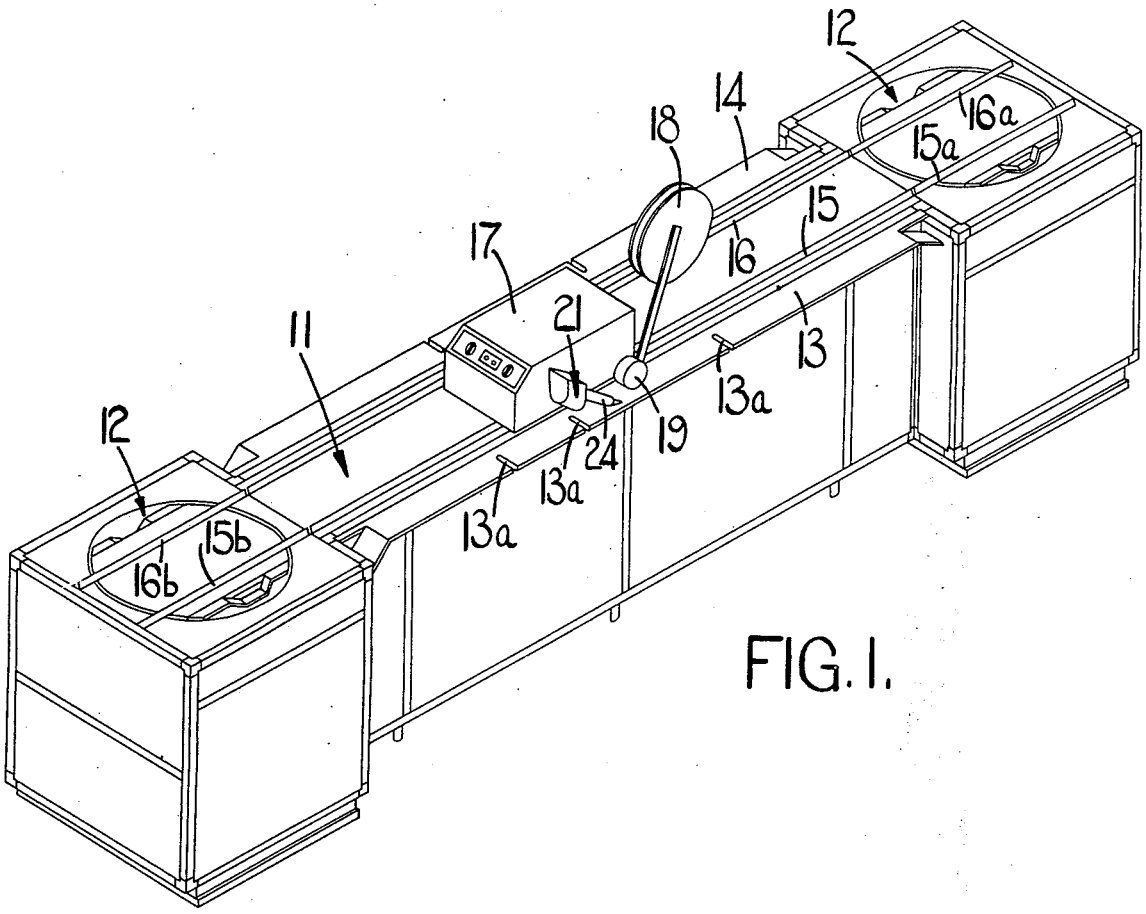
Figure 2:
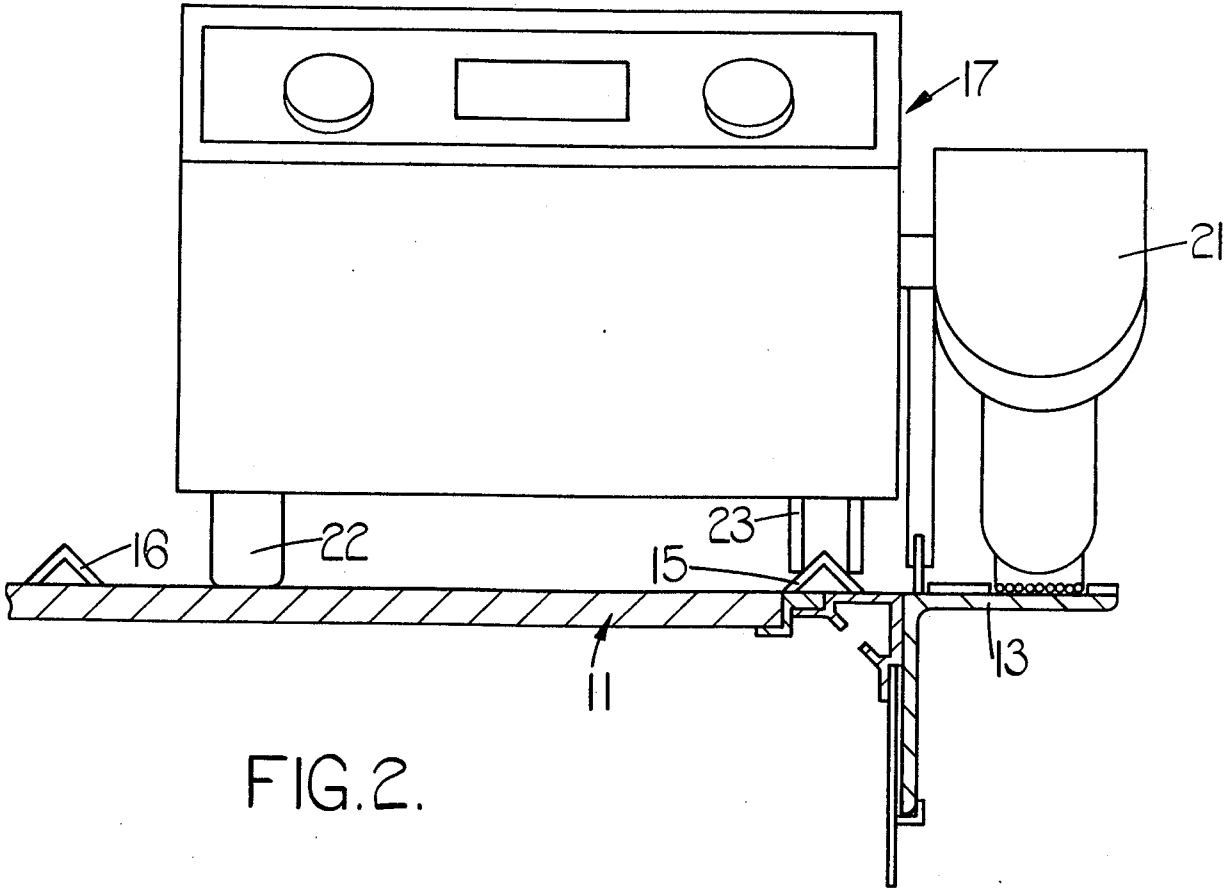
Figure 3:
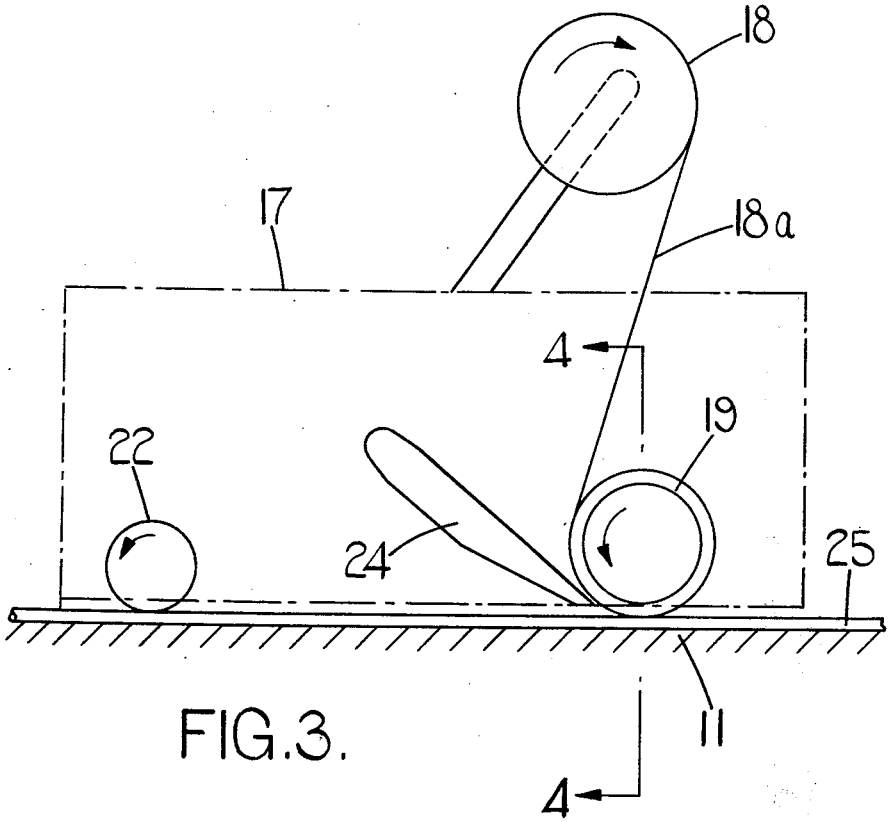
Figure 4:
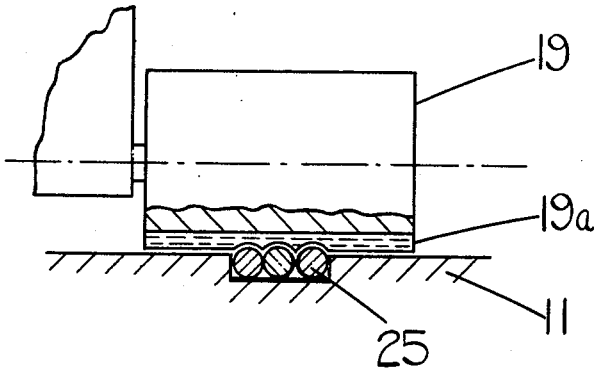
Figure 6:
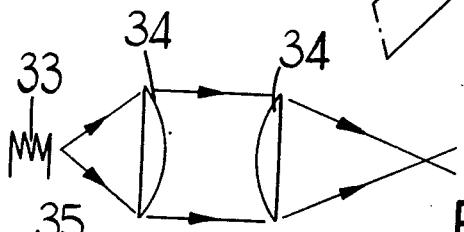
Figure 7:
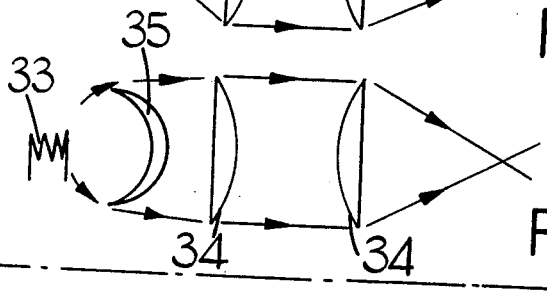
Figure 8:
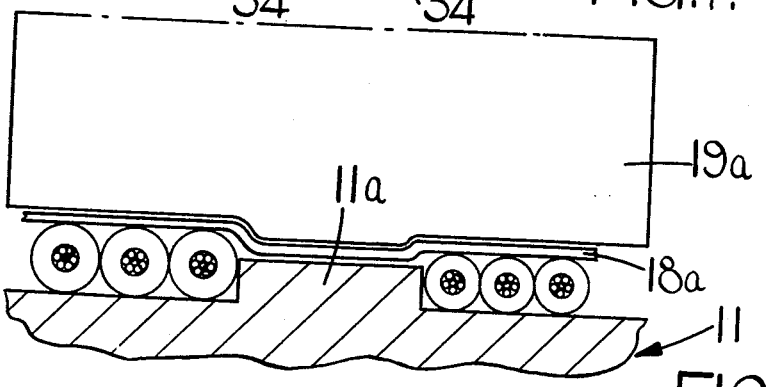

One example of the invention is illustrated in the accompanying drawings, wherein FIG. 1 is a perspective view of apparatus for use in the manufacture of an electrical wiring harness, FIG. 2 is a fragmentary transverse sectional view of part of the apparatus shown in FIG. 1, but to an enlarged scale, FIG. 3 is a diagrammatic representation of a further part of the apparatus shown in FIG. 1, FIG. 4 is a sectional view, to an enlarged scale, on the line 4—4 in FIG. 3, FIGS. 5, 6 and 7 are diagrammatic representations of three alternative heating systems for use in the apparatus shown in FIG. 1, and FIG. 8 is a view similar to FIG. 4 illustrating an alternative platform construction.

Referring first to FIGS. 1 to 4 of the drawings the apparatus includes an elongated platform 11 having a turntable unit 12 at each end thereof. That portion of the platform 11 intermediate the turntable units 12 includes a pair of parallel longitudinally extending lead supporting portions 13, 14 the portions 13, 14 defining the opposite longitudinal edges of the platform. The upper surface of the platform 11 carries a pair of guideways 15, 16 each of which is adjacent, and associated with a lead supporting portion. Each of the guideways 15, 16 includes a pair of separate end portions indicated by the suffixes *a* and *b* carried by the turntables of the units 12. The guideways 15, 16 are defined by metal stock of L-shaped cross-section secured on the platform 11 with its apex upper most.

Positioned on the platform 11 is a unit 17 including a tape dispenser spool 18, a pressure member 19 and a heater 21. The unit 17 includes an electric motor which drives a platform engaging wheel 22 whereby the unit is driven along the platform the unit further including an idler wheel 23 having therein a circumferentially extending V-shaped groove, the wheel 23 engaging one or other of the guideways 15, 16 depending upon which of the lead supporting portions 13, 14 is in use. The spool 18 is free running, and carries a tape of thermoplastic material. The pressure member 19 is in the form of a cylindrical roller the outer surface of which is defined by a rubber sleeve 19*a*. The roller 19 is driven at the same speed as the wheel 22 by the electric motor of the unit 17. The heater 21 is the kind including a shaped nozzle 24, the nozzle 24 directing heated air to the region adjacent the roller 19. The electric heater element and the fan of the heater 21 are housed within the casing of the unit 17, and the nozzle 24 is movable between a rest position wherein the heater is automatically switched off, and an operative position wherein the heater is operating under the control of manually settable devices on a control panel of unit 17.

The operation of the apparatus is as follows.

The unit 17 is positioned on the right hand turntable unit 12 with the idler wheel 23 engaged on the guideway 15. Conductive leads each encased in a thermoplastic sheath are laid on the lead supporting region 13 extending along the length of the region 13 and conveniently the leads are side by side and touching. The leads can be of different diameters if necessary, and the region 13 is provided at predetermined points along its length with transverse apertures 13*a* whereby leads can be inserted into, or led out of the wiring harness. At the ends of the region 13 the leads extend down ramp surfaces so as to lie below the level of the platform 11. The free end of the tape carried by the spool 18 is fed under the roller 19, and the unit 17 is moved along the guideway 15 until the roller 19 engages the leads laid on the lead supporting region 13. The roller 19 presses the free end of the tape 18*a* (FIG. 3) onto the leads 25 (FIGS. 3 and 4) and the nozzle 24 is then brought manually to its operative position. Upon reaching its operative position the nozzle 24 directs hot air onto the leads 25 and the tape 18*a* in the region of the roller 19, and simultaneously the drive motor of the unit 17 is energised. Thus the unit 17 is driven along the length of the platform 11 and as the unit 17 progresses along the platform 11 tape 18*a* is drawn from the spool 18 and applied by the roller 19 to the leads 25. The temperature of the air issuing from the nozzle 24 is sufficient to raise the temperature of the tape 18*a* and the sheaths of the leads 25 to a point at which the sheaths fuse to the tape as the tape is pressed into contact with the sheaths by the roller 19. Thus the leads on the lead supporting region 13 of the platform 11 are secured together along the length of the region 13 by a length of tape 18*a*. As the unit 17 reaches the left-hand turntable 12 a mechanism (not shown) switches off the heater 21 and the drive motor of the unit. The tape 18*a* can then be cut and the leads 25 together with their length of tape can be removed from the lead supporting region 13.

While the leads are being positioned on the region 13, and secured together by means of the tape 18*a* further leads can be positioned on the lead supporting region 14 of the platform 11. Thus when the region 17 reaches the left hand turntable unit 12 the unit 17 can be rotated through 180° by means of the turntable so that the guideway portion 15*b* alignes with the guideway 16 and the unit 17 can perform an operating stroke along the lead supporting region 14, terminating on the right hand turntable unit 12 whereupon the unit 17 can again be rotated trhough 180° in readiness for a further operation on the lead supporting region 13.

Figure 5:
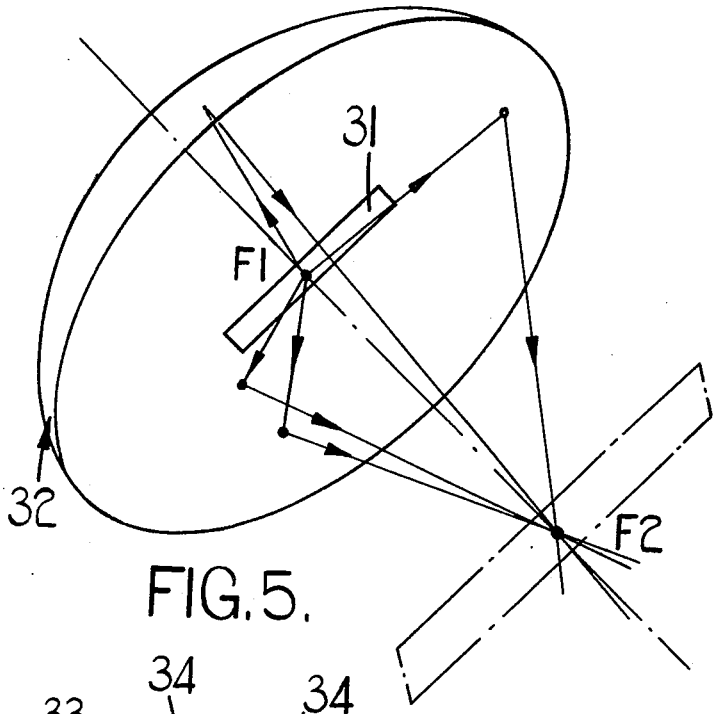

Referring now to FIG. 5 the heating system shown is intended to replace the hot air system including the nozzle 24 of the basic apparatus. Thus the heater system of FIG. 3 will be part of a unit similar in other respects to the unit 17. The system includes a source of radiant heat 31, conveniently an infra-red source in the form of an electrically heated filament in a glass, or quartz envelope. The filament is elongated, and is positioned at right angles to the major axis of an ellipsoidal reflector 32. The filament is so positioned that one focus of the ellipsoidal reflector 32 occurs mid-way between the ends of the elongated source 31, and the source is arranged to be parallel with the line of contact between the tape 18*a*, and so heat radiated from the source 31, in this case in the form of infra-red radiation, is focussed by the reflector 32 to form a line, or band image along the line of contact between the tape 18*a* and the leads 25. Thus the mutually presented surfaces of the tape and the leads are heated, and the arrangement is such that the mutually presented surfaces are heated to a temperature sufficient to cause fusion between the tape and the sheaths of the leads when the tape is pressed into contact with the sheaths of the leads by the roller 19.

An alternative heating system is shown in FIG. 6, and it is to be appreciated that again the system will be incorporated into a unit similar to the unit 17. The source of radiant heat is the elongated filament of a generally conventional light bulb, the filament being heated to incandescense by an electric current in the normal manner. The filament is positioned with its axis parallel to the line of contact between the tape 18*a* and the leads 25, and radiation from the filament, both radiated heat, and radiated light, is focussed by a condenser lens system 34. Thus one focus of the condenser lens system 34 is mid-way between the ends of the filament, and the other focus of the condenser lens system is between the ends of the line of contact between the tape and the leads. Since the filament is elongated, then a parallel line image is formed at the line of contact between the tape 18*a* and the leads 25 by means of which the mutually presented surfaces of the tape and the leads are heated.

FIG. 7 is a modification of the arrangement shown in FIG. 6 in that a meniscus convex lens 35 is interposed between the filament 33 and the condenser lens system 32. The lens 35 is provided to collect radiation from the filament 33 over an increased angle by comparison with the condenser lens system 34 used alone.

Since in both of the condenser lens arrangements described above the source is elongated, then the lenses can be spherical convex lenses. If it is desired to use a point light source then the second lens of the condenser lens system should be a cylindrical convex lens positioned to produce the line, or band image along the line of contact between the tape 18*a* and the leads 25. Moreover, it is envisaged that other forms of image spreading optical devices could be utilized, and it is to be appreciated that there are many possible different forms of optical system for achieving a line image from line, or point sources.

Where the source of radiant heat produces predominantly infra-red radiation then it is desirable to use a reflector in preference to lenses to produce the line image. This preference arises from the necessity to manufacture lenses for infra-red systems from specialised and expensive materials.

In a further modification not shown the heat source of the apparatus is a laser the radiation output of which is concentrated, or collimated in known manner to produce a line, or band of radiation along the line contact between the tape and the leads.

The constructions described above differ in the form of heater means which is utilized. The platform 11 will be basically the same for each of the alternatives, and in order to provide automatic identification of the harnesses produced the platform 11 on which the leads 24 are laid is provided adjacent the lateral boundary of the leads with legends indicative of the harness being produced, and if desired the date of manufacture. The legends are formed in relief, in panels secured to the platform 11, and are so positioned as to be overlapped by an edge region of the tape 18*a* during construction of the harness. Thus since the legends are in relief, then when the heated tape is pressed into contact with the legends by the roller 19 then the legends will be impressed onto the tape, and so will be visible on the marginal region of the tape of the finished harness. Since the panels carrying the legends are readily detachable, the information impressed onto the tape can be readily changed.

In addition to impressing for example the code number and date of manufacture of the particular harness onto the tape of the harness it is possible in the same manner to provide on the tape of the harness identification of leads leaving the main run of the harness laterally between the ends of the harness.

When the harness is being manufactured the leads 25 are cut to the exact length required and are provided with connectors at their ends prior to arranging leads 25 on the platform 11. The leads 25 are then arranged on the platform 11 in the desired manner, it being appreciated that leads will enter and leave the main run of the harness intermediate the ends of the platform. The tape 18*a* is then fused to the sheaths of the leads along the length of the platform and as described above where leads enter and leave the main run the tape can carry identification impressed into the tape, of the intended function of the lead. Such information is of course particularly useful when the harness is being assembled into a road vehicle, since it would not be essential for the person assembling the harness into the vehicle to rely only on his knowledge of conventional colour coding of cables. Thus a lead leaving the main run of the harness to go to for example the horn of a road vehicle could be identified by the word "horn" impressed onto the tape adjacent the point at which the lead leaves the main run of the harness.

It will be appreciated that for many applcations it will be necessary for the harness to include leads of different diameters. The rubber sleeve 19*a* on the roller 19 is sufficiently resilient to accommodate leads of different diameter in the same operation, the sleeve 19*a* deforming by different amounts so that the tape 18*a* is pressed firmly onto the leads even though they are of different diameter. However, in order to minimise the amount of distortion which is required of the sleeve 19*a* of the roller 19 the modification shown in FIG. 8 can be employed. The platform 11 is provided with an upstanding rib 11*a* the height of which is slightly less than the diameter of the small diameter leads. The small diameter leads are positioned at one side of the rib 11*a* and the large diameter leads are positioned at the opposite side of the rib 11*a*. Thus rather than having a very steep change in level between the large diameter leads and the small diameter leads the two sizes of leads are spaced apart by the rib 11*a* which of course has the effect of reducing the steepness of the change in level by spacing the two sets of leads laterally.

Where a number of different diameters of lead are used, then where possible they will be graduated in size across the width of the platform, and in such a situation of course there is no need to utilize the rib 11*a* since the leads of intermediate size will perform a similar function.

It is to be appreciated that since by using the apparatus described above the leads can be initially cut to the exact required length, and can be provided before assembly into the harness, with their requisite terminals, considerable savings both in wire, and manufacturing time are achieved by comparison with conventional methods of manufacture.

It will be recognised that the lead supporting regions 13, 14 of the platform 11 need not be the same. Moreover, the harness constructed on either of the regions 13, 14 may be a complete harness, or may be a part of a larger harness. For example, in a harness there may be a plurality of harness portions each of which includes leads secured together by lengths of thermoplastic tape in the manner described above. The harness portions being interconnected by conventional harness portions which are bound with insulating tape.

Good fusion has been achieved between leads having polyvinylchloride sheaths and polyvinylchloride tape using the apparatus described above. However, it is believed that satisfactory results will also be obtained using sheaths and tape of any one of polyethylene, melamine, acrylic materials, nylon and polypropylene.

It is to be appreciated that the speed at which the unit 17 transverses the platform, and the heat output of whichever heater means is utilized are so controlled in relation to the material of the tape and the sheaths of the leads that the tape and the sheaths of the leads are raised to a temperature sufficiently high to achieve fusion between the tape and the sheaths, without causing burning of the sheaths and the tape.

The harnesses, and harness parts produced by any of the various forms of the apparatus described above are particularly intended for use in motor vehicles. However, it is to be appreciated that wiring harnesses for other applications can be manufactured using the apparatus. For example, the type of harness which is produced by this apparatus may also be extremely useful in marine applications, and in domestic applications, for example in automatic washing machines and the like.

We claim:

1. Apparatus for use in the manufacture of a wiring harness, the apparatus including s platform upon which the harness leads, each including an outer thermoplastic sheath, are supported, the platform being arranged to support the leads in the pattern which they will occupy in the harness, and being apertured to permit lead-in, and branch-out of leads intermediate the ends of the harness, and, a heater unit movable along the length of the platform, said heater unit including a dispenser for dispensing thermoplastic tape onto the harness leads as the unit traverses the platform, means for heating the mutually presented surfaces of the thermoplastic tape and the thermoplastic sheaths of the leads, and, a pressure member urging the heated surfaces of the tape and the leads into contact so that the sheaths of the leads fuse to the tape along the length of the tape as the unit traverses the length of the platform.

2. Apparatus as claimed in claim 1 wherein the heater means is a hot air blower.

3. Apparatus as claimed in claim 1 wherein the heater means includes a radiant heat source and means for focussing radiant heat from the source onto the mutually presented surfaces of the leads and the tape.

4. Apparatus as claimed in claim 3 wherein the radiant heat source is an infra-red source and the associated focussing means is an ellipsoidal reflector.

5. Apparatus as claimed in claim 3 wherein the radiant heat source is an incandescent filament and the focussing means associated with the filament is a lens system.

6. Apparatus as claimed in claim 1 wherein the heater means is a laser.

7. Apparatus as claimed in claim 1 wherein said pressure member is a roller with a resilient surface whereby the roller can accommodate leads of different diameter in the same operation.

8. Apparatus as claimed in claim 1 where the harness to be produced includes leads of different diameter then said platform includes an upstanding rib whereby leads of large diameter can be spaced from leads of smaller diameter laterally of the platform.

9. Apparatus as claimed in claim 1 wherein said unit includes a drive arrangement whereby the unit is driven along the platform, the platform including guideways guiding the movement of the unit along the platform.

10. Apparatus as claimed in claim 1 wherein the platform includes a pair of parallel lead supporting portions extending along the length of the platform and spaced apart, the platform including at one end thereof a turntable whereby said unit can perform an operating stroke along one of said lead supporting portions, and then can be rotated through 180° using said turntable in order to perform an operating stroke in the other direction along said other lead supporting portion.

11. Apparatus as claimed in claim 10 further including a second turntable at the opposite end of the platform from the first mentioned turntable.

12. Apparatus as claimed in claim 1 wherein the or each lead supporting portion of the platform is provided with transversely extending apertures whereby leads can be inserted and led out of the harness intermediate the ends of the taped portion of the harness.

13. Apparatus as claimed in claim 1 wherein the platform upon which the leads are supported includes, in relief, legends associated with the harness being produced, and the tape dispensed onto the leads overlaps the legends so that during passage of the pressure member over the legends on the platform the legends are impressed onto the tape.

14. Apparatus as claimed in claim 13 wherein the legends are carried by one or more detachable panels on the platform.

* * * * *